US005342044A

United States Patent [19]

You

[11] Patent Number: 5,342,044

[45] Date of Patent: Aug. 30, 1994

[54] GAME RACKET

[76] Inventor: Chin-San You, No. 6, Lane 477, Sec. 2 Feng-Shyn Rd., Feng Yuan City, Taichung Hsien, Taiwan

[21] Appl. No.: 92,819

[22] Filed: Jul. 19, 1993

[51] Int. Cl.[5] ..... A63B 49/02

[52] U.S. Cl. ..... 273/73 D; 273/73 C

[58] Field of Search ..... 273/73 R, 73 C, 73 D, 273/73 H, 73 K

[56] References Cited

U.S. PATENT DOCUMENTS 1,173,588 2/1916 Larocque ..... 273/73 D X
3,968,966 7/1976 D'Aquanni ..... 273/73 D
5,037,097 8/1991 Svoma et al. ..... 273/73 D X

FOREIGN PATENT DOCUMENTS 3739433 6/1989 Fed. Rep. of Germany ... 273/73 D
3805920 9/1989 Fed. Rep. of Germany ... 273/73 D
2596995 10/1987 France ..... 273/73 D
9001974 3/1990 World Int. Prop. O. ..... 273/73 D

*Primary Examiner*—William E. Stoll
*Attorney, Agent, or Firm*—Browdy and Neimark

[57] ABSTRACT

A game racket with a head frame having an outer peripheral surface and an inner peripheral surface defining an oval area. The head frame is provided with a first set of string holes and a second set of string holes. Each of the second set of string holes is located below a center portion of two adjacent string holes of the first set. The outer peripheral surface is provided with a first groove and a second groove. A string is strung such that it is threaded through each pair of of the adjacent string holes of the same set through the oval area to crisscross and interlace each string section bridging two adjacent string holes located in the corresponding first or second groove.

1 Claim, 6 Drawing Sheets

GAME RACKET

FIELD OF THE INVENTION

The present invention relates generally to a game racket, and more particularly to a game racket having an innovative stringing structure.

BACKGROUND OF THE INVENTION

As shown in FIG. 1, the prior art game racket has a head frame 1 provided with string holes 2 in the same plane. A string 3 is threaded through a series of string holes 2 to form a ball striking surface in the head frame 1. Such a prior art game racket as described above is defective in that the dynamic tension of a ball exerting on the ball striking surface is borne only by the two strings 4 and 5 which are adjacent to each other, thereby causing the strings 4 and 5 to be vulnerable to breakage. In addition, the dwell time of the ball on the strings 4 and 5 is exceedingly short. As a result, it is often difficult for a player to control the traveling direction of a returned ball with such game racket. Moreover, the arm and the elbow of the player using such game racket are subjected to a bodily pain or injury caused by the shock generated by the game racket.

SUMMARY OF THE INVENTION

It is therefore the primary objective of the present invention to provide a game racket which can increase the effective string length capable of bearing the dynamic tension of a ball that hits the game racket.

It is another objective of the present invention to provide a game racket which can increase the string section length between two adjacent string holes. In such situation, the collapse chance of the portion of the game racket where the string section bridges will reduced.

The foregoing objectives of the present invention are achieved by a game racket comprising a handle and a head frame at an end of said handle. The head frame has an outer peripheral surface substantially perpendicular to the plane of the head frame. The head frame further has an inner peripheral surface defining an oval area within the head frame. In addition, the head frame comprises a first set of string holes and a second set of string holes. The string hole axes of the first set of string holes are located in an abstract plane parallel to the plane of the head frame. The string hole axes of the second set of string holes are situated in another abstract plane also parallel to the plane of the head frame. There is at least one string that is threaded through each of the string holes such that the string crisscrosses and interlaces to form a ball-striking surface in the head frame. Each of the second set of string holes is located on its plane at the center of the two adjacent string holes of the first set. The outer peripheral surface is provided with a predetermined number of a first set of string-receiving slots and a predetermined number of a second set of string-receiving slots, which are respectively corresponding in location to the abstract planes. The outer ends of the first set of string holes are located in pairs in the first set of string-receiving slots while the outer ends of the second set of string holes are situated in pairs in the second set of string-receiving slots. The string is strung in such a manner that it is threaded through each pair of adjacent string holes of the same set to pass through the oval area, and that the string chord sections passing the two adjacent string holes are received in the string-receiving slots.

DETAILED DESCRIPTION OF THE INVENTION

Figure 1:
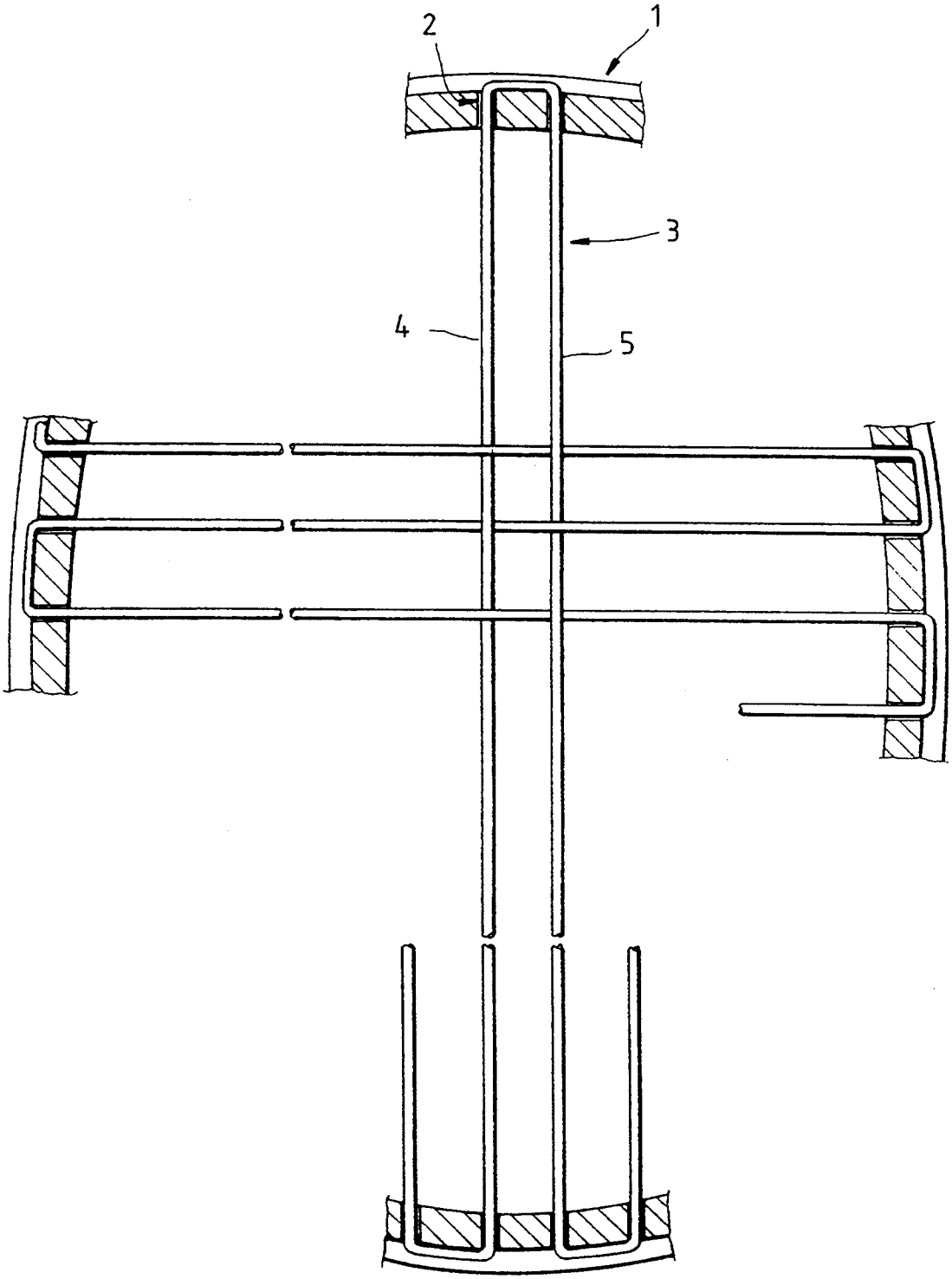
FIG. 1 PRIOR ART
FIG. 1 shows a partial sectional schematic view of a prior art game racket.
Figure 2:
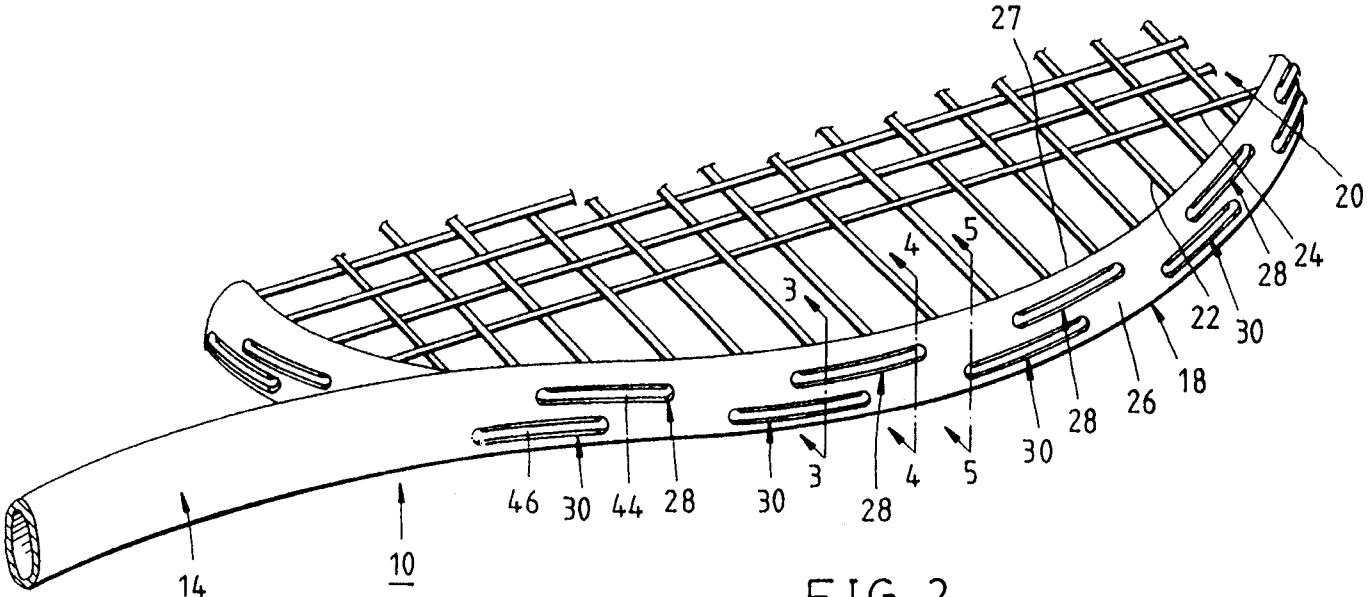
FIG. 2 shows a partial perspective view of a game racket of the present invention.
Figure 5:
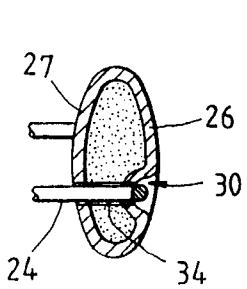
FIG. 5 shows a sectional view of a portion taken along the line 5—5 as shown in FIG. 2.
Figure 4:
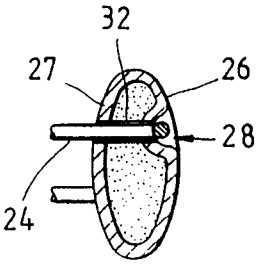
FIG. 4 shows a sectional view of a portion taken along the line 4—4 as shown in FIG. 2.
Figure 3:
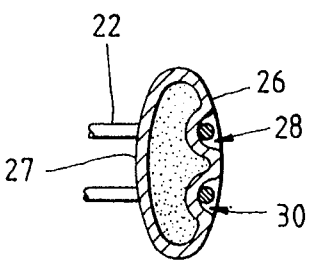
FIG. 3 shows a sectional view of a portion taken along the line 3—3 as shown in FIG. 2.
Figure 6:
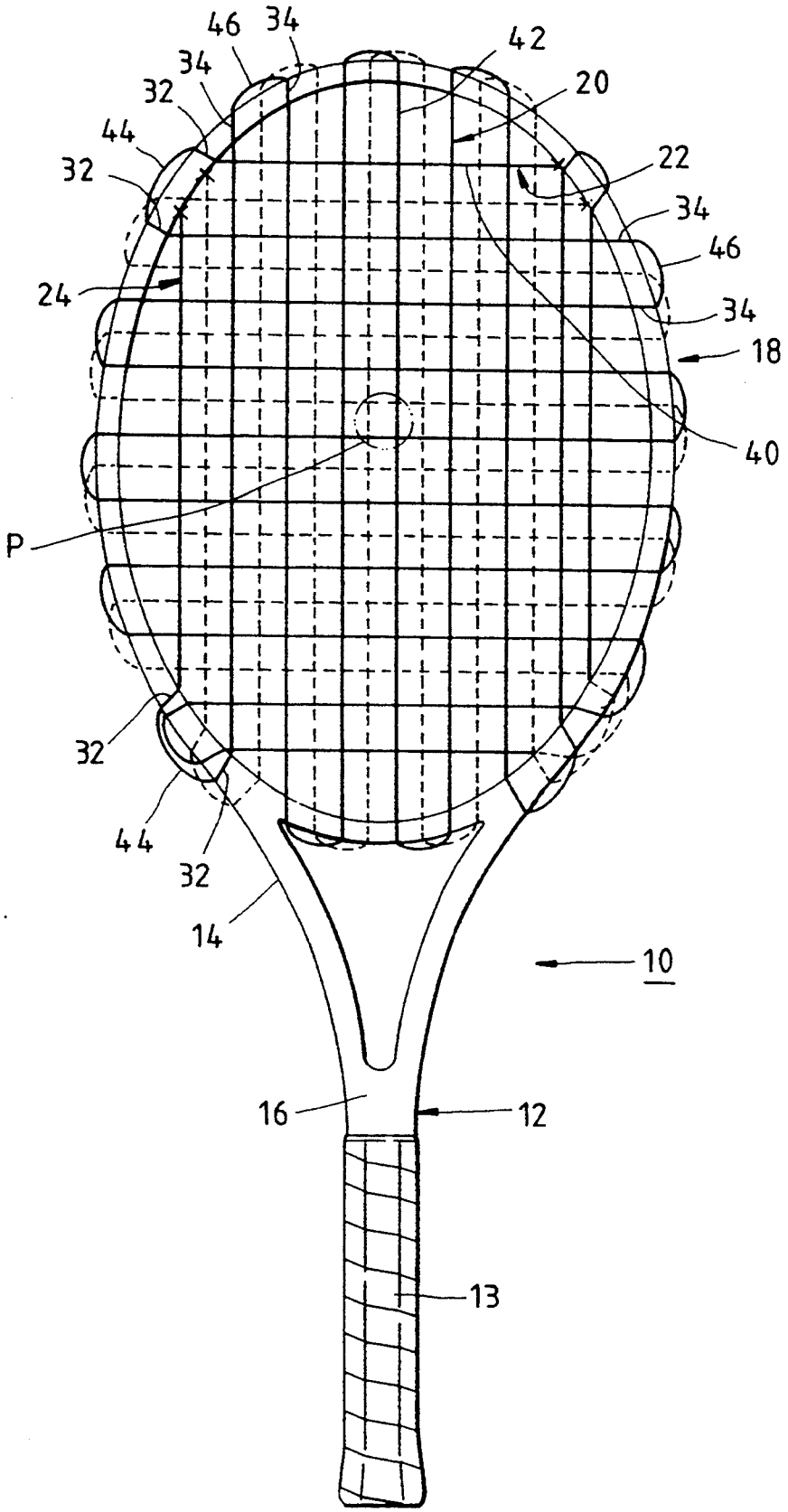
FIG. 6 shows a front elevational view of a first preferred embodiment of the present invention.

Referring to FIGS. 2–6, a game racket 10 of the first preferred embodiment of the present invention is shown to comprise a handle 12 which extends from a hand grip 13 along a shaft 16 to a throat 14 which is connected to a head frame 18. The game racket 10 of the present invention is made of wood, or metal, or plastic composite material.

The head frame 18 and the longitudinal of handle 12 are located in the same plane with head frame 18 defining an oval area 20. The head frame comprises a ball-striking surface formed by two interlacing strings 22 and 24.

The head frame 18 has an outer peripheral surface 26 and an inner peripheral surface 27 defining the oval area 20.

The outer peripheral surface 26 is provided with a plurality of first set of string receiving slots 28, which are spaced at a predetermined interval and are corresponding in location to an abstract plane situated at an upper side of the ball striking surface. The outer peripheral surface 26 is further provided with a plurality of second set of string receiving slots 30, which are spaced at a predetermined interval and are corresponding in location to another abstract plane situated at a lower side of the ball striking surface. Two ends of each of the second set of string receiving slots 30 lie in their plane below the center of the two adjacent first set of string receiving slots 28. Both ends of each of the first set string receiving slots 28 are provided respectively with a first set string hole 32 passing through perpendicularly the inner and the outer peripheral surfaces 27 and 26. Both ends of each of the second set string receiving slots 30 are provided respectively with a second set string hole 34 passing through perpendicularly the inner and the outer circumferential surfaces 27 and 26.

The string 22 is strung in such a manner that it is threaded through the string holes 32 and 34 parallel to the short axis of the head frame 18, so as to form the horizontal string set. In the process of stringing, the string 22 is inserted into the first set string hole 32 located at one side of the short axis so as to pass through the oval area 20 before emerging through the second set string hole 34 located at another side of the short axis. Subsequently, the string 22 is put into another second set string hole 34 adjacent to the previous second set string hole 34, so as to pass through the oval area 20. Such a stringing method as described above permits the belt-striking surface to be constructed with a uniform stringing pressure.

Similarly, the string 24 is strung through the string holes 32 and 34 parallel to the longitudinal axis of the head frame 18, so as to form the longitudinal string set. Each chord section 40 of the horizontal string set and each chord section 42 of the longitudinal string set interlace in a crisscross pattern to form the ball-striking surface of the head frame 18. Upon the completion of the ball-striking surface of the head frame 18, the strings 22 and 24 form respectively the bridging chord sections 44 and 46 located respectively in the string receiving slots 28 and 30. In order to prevent the friction between the string and the wall surface of the string hole, a string protective jacket of a plastic material may be inserted into the string hole before the stringing process is under way. The string protective jacket mentioned above is similar in structure and function to the string protective jackets that are commonly used in the prior art game rackets.

Figure 7:
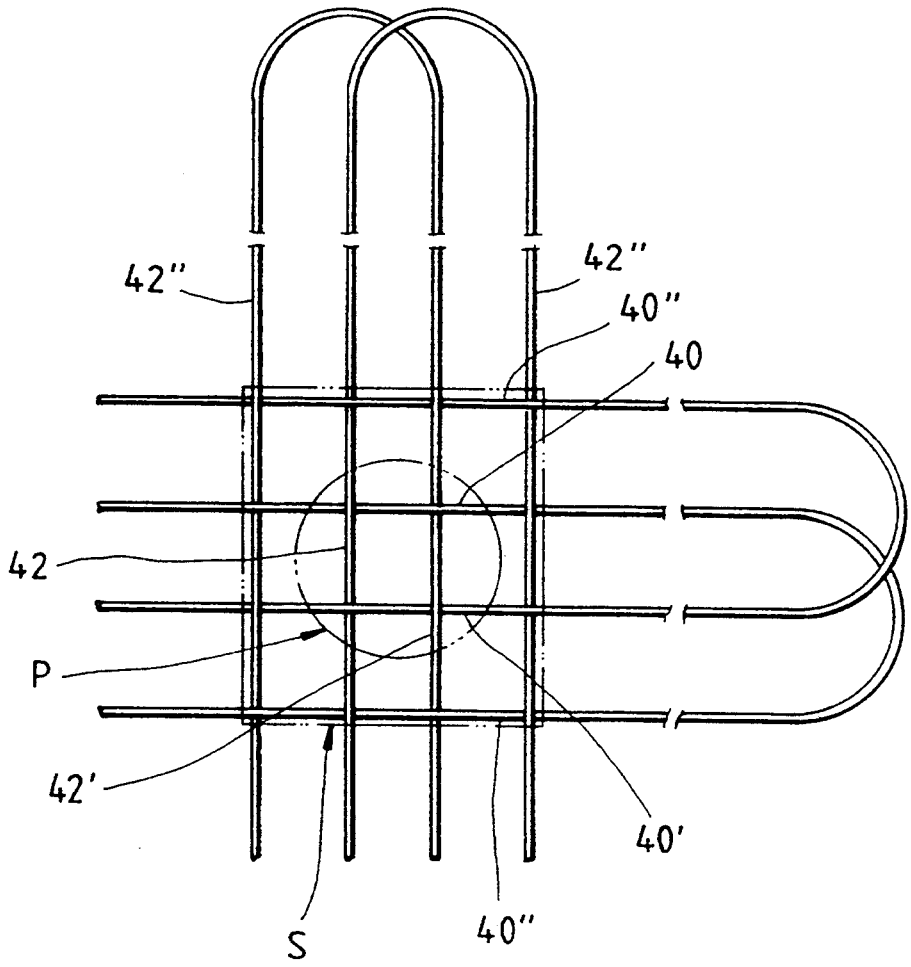
FIG. 7 shows an enlarged view of the P portion as shown in FIG. 6.

Now referring to FIGS. 1 and 7, a comparison of the prior art game racket with the game racket of the present invention shows that the game racket 10 of the present invention has two horizontal chord sections 40 and 40' adjacent to each other and two longitudinal chord sections 42 and 42' adjacent to each other, and that these horizontal chord sections and longitudinal chord sections are put through the string holes which are not adjacent to each other. In other words, these neighboring chord sections 40, 40', 42 and 42' are not interconnected. As a result, when the ball-striking surface of the game racket 10 of the present invention is impacted by a ball, the dynamic tension so generated on the two neighboring chord sections is therefore imparted to other chord sections which are not impacted by the ball but are connected with the impacted chord sections. Therefore, the game racket 10 of the present invention is at least two times as effective as the prior art game racket in imparting the dynamic tension described above.

The effectiveness of the game racket 10 of the present invention in bearing the dynamic tension of the ball-striking surface is further substantiated by the following material evidence, as illustrated in FIG. 7. As a ball is hit by the game racket of the present invention, the ball makes contact with the ball-striking surface of the game racket in such a manner that a circular tangent plane of the ball makes contact with the strung surface. The circular tangent plane of the ball is about 13 mm in diameter. The prior art game racket is provided with a strung surface S of rectangular shape and having a side length of 35 mm. The strung surface S is formed by four longitudinal chord sections and four horizontal chord sections. The contact area P between the ball and the strung surface is not expected to be greater than the rectangular area S surrounded by the four neighboring horizontal chord sections 40 and the four neighboring longitudinal chord sections 42. The contact area P contains two adjacent horizontal chord sections, which are connected directly with two adjacent longitudinal chord sections. This means that the prior art game racket has only four chord sections that work to bear the dynamic tension exerting on the strung surface at the time when the ball hits the prior art game racket. By comparison, the game racket of the present invention is provided with string chord sections which are adjacent to one another and are not interconnected. In other words, the two neighboring horizontal chord sections 40 and 40' are respectively capable of imparting the dynamic tension to another horizontal chord section 40'' which is not impacted by the ball. Similarly, the two neighboring longitudinal chord sections 42 and 42' are respectively capable of imparting the dynamic tension to another longitudinal chord section 42'' which is not impacted by the ball. As a result, the game racket of the present invention has at least eight chord sections that work to carry the dynamic tension exerting on the contact area P. Therefore, each of the eight chord sections of the game racket of the present invention is expected to carry the dynamic tension of a smaller magnitude, as compared with each of the four chord sections of the prior art game racket.

The advantages inherent in the game racket 10 of the present invention are readily apparent and expounded explicitly hereinafter.

The game racket 10 of the present invention can be strung under a high dynamic tension without an incident that the string breaks.

The dwell time of a ball on the strung surface of the game racket 10 of the present invention is prolonged, thanks to an increase in the deflection of the strung surface of the ball-striking area of the game racket 10.

The game racket 10 of the present invention is provided with more string chord sections capable of absorbing and attenuating the impact energy of a ball which hits the strung surface of the game racket 10, thereby minimizing the risk that the arm or the elbow of a player holding the game racket 10 is hurt.

The game racket 10 of the present invention has a head frame 18 provided with the bridging chord sections 44 and 46, which are almost twice as long as those of the prior art game racket. As a result, the portion where these chord sections 44 and 46 bridge is much less vulnerable to collapse.

Figure 8:
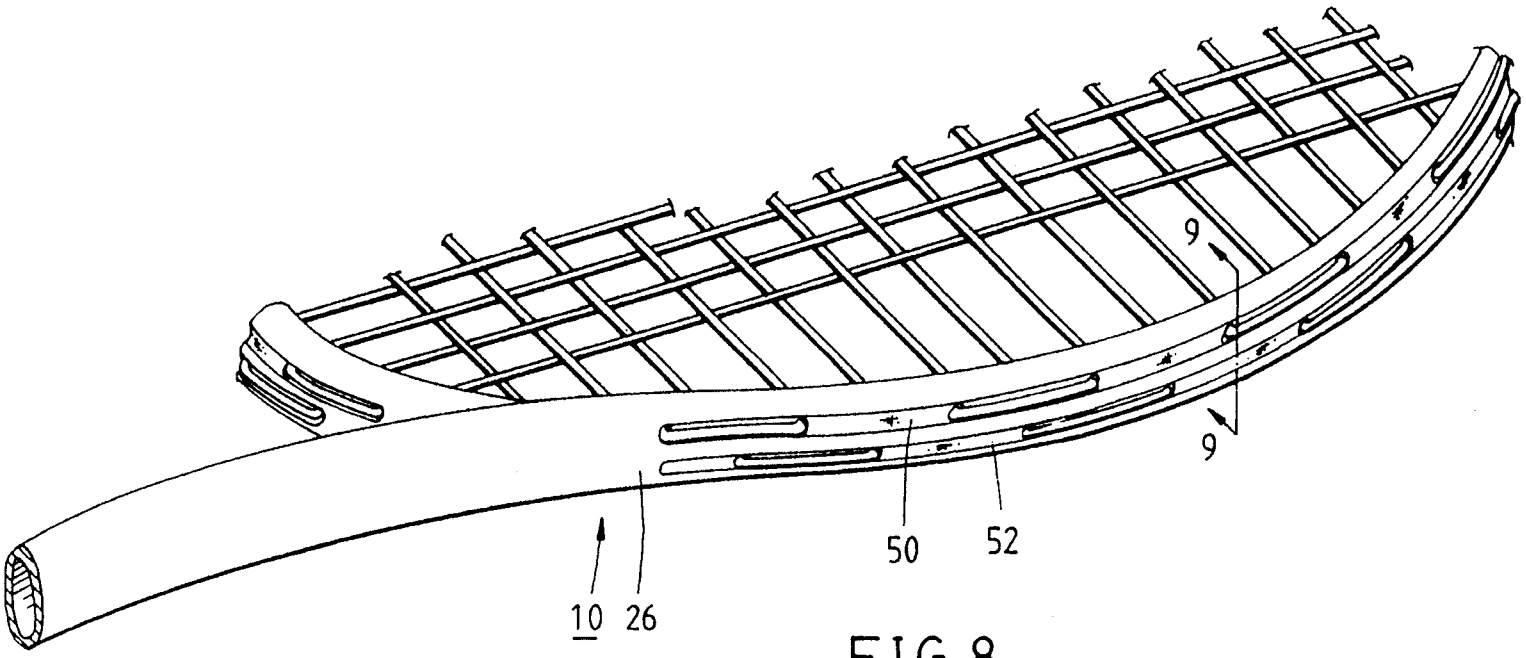
FIG. 8 shows a partial perspective view of a second preferred embodiment of the present invention.
Figure 9:
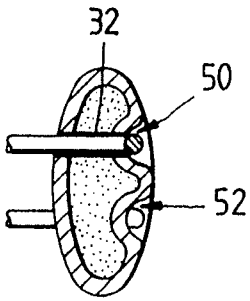
FIG. 9 shows a sectional view of a portion taken along the line 9—9 as shown in FIG. 8.
Figure 10:
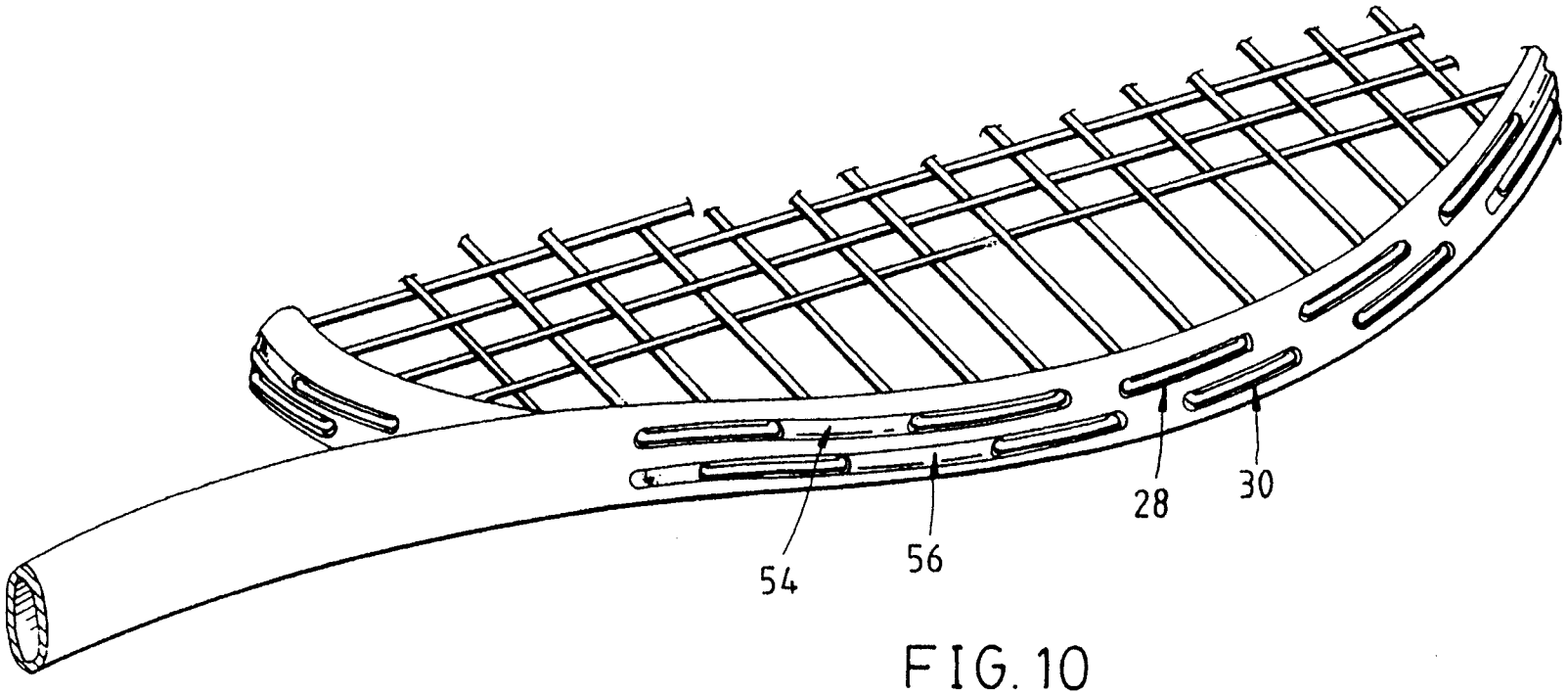
FIG. 10 shows a partial perspective view of a third preferred embodiment of the present invention.

As illustrated in FIGS. 8, 9 and 10, the string receiving slots 28 and 30 of the game racket 10 of the present invention may be so interconnected as to form two outer peripheral slots 50 and 52, which substantially circumscribe the outer peripheral surface 26 of the head frame 18. Similarly, the string receiving slots 28 and 30 located in other areas may be so interconnected as to form two grooves 54 and 56, which are parallel to each other.

What is claimed is:

1. A game racket comprising:

an elongated handle;

a head frame at an end of said handle forming a closed oval area, said head frame having an outer peripheral surface engaged to an inner peripheral surface which defines said oval area;

a cross-section through said outer peripheral surface and said inner peripheral surface being oval;

a plurality of string holes disposed in said head frame such that said string holes are grouped as a first set of string holes and a second set of string holes, at least one string threaded through said string holes and extending across said oval area in a crisscross and interlaced pattern to form a string surface within said oval area;

said first set of string holes having axes located in a first plane parallel to and above said string surface, and said second set of string holes having axes situated in a second plane parallel to and below said string surface;

wherein each of said second set of string holes is respectively located below a center portion between two adjacent string holes of said first set of string holes;

a first groove in said first plane and on said head frame having a substantially semi-circular wall located below said outer peripheral surface;

a second groove in said second plane and on said head frame having a substantially semi-circular wall located below said outer peripheral surface;

said first groove and said second groove each having a length substantially equal to a length of said outer peripheral surface to protect the stringing and reinforce the structural strength of the frame against impacts with the playing surface;

said first set of string holes located in said first groove;

said second set of string holes located in said second groove;

wherein said string is threaded through said head frame such that said string enters and departs two adjacent string holes of said first set of string holes or said second set of string holes, and that said string has a string section bridging said two adjacent string holes so as to be received within said substantially semi-circular wall of either said first groove or said second groove.

* * * * *